US006712709B1

(12) United States Patent
Henderson et al.

(10) Patent No.: US 6,712,709 B1
(45) Date of Patent: Mar. 30, 2004

(54) TEETER-TOTTER

(75) Inventors: Gregg A. Henderson, Munroe Falls, OH (US); Andrew B. Logar, Willowick, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 10/260,921

(22) Filed: Sep. 30, 2002

(51) Int. Cl.[7] ..... A63G 11/00
(52) U.S. Cl. ..... 472/106; 472/111
(58) Field of Search ..... 472/106, 108, 472/109, 110, 111, 112; 248/346.01, 346.03, 678, 127; 403/231, 382, 402, 403; 52/94, 698, 655.1

(56) References Cited

U.S. PATENT DOCUMENTS

| | | | | | |
|---|---|---|---|---|---|
| 292,254 | A | * | 1/1884 | Rich | 472/106 |
| 1,349,701 | A | | 8/1920 | Wallace | |
| 1,566,765 | A | | 12/1925 | Natale | |
| 2,111,339 | A | * | 3/1938 | Squires | 473/475 |
| 2,198,947 | A | | 4/1940 | Olson | |
| 3,164,965 | A | * | 1/1965 | Martin | 405/2 |
| 3,675,919 | A | * | 7/1972 | Ewers | 472/113 |
| 4,218,835 | A | | 8/1980 | Iseki | |
| 4,240,213 | A | | 12/1980 | Lutin | |
| 4,267,682 | A | * | 5/1981 | Fowler et al. | 52/657 |
| 5,238,455 | A | | 8/1993 | Cain, Jr. et al. | |
| 5,333,825 | A | * | 8/1994 | Christensen | 248/188.2 |
| 5,512,018 | A | | 4/1996 | Zimmers | |
| D377,512 | S | | 1/1997 | Lenihan | |
| 5,776,002 | A | | 7/1998 | Weber | |
| 6,142,560 | A | | 11/2000 | Miller | |
| 6,241,312 | B1 | | 6/2001 | Watts et al. | |
| 6,306,068 | B1 | | 10/2001 | Heatwole | |
| 6,379,256 | B1 | | 4/2002 | Gatto | |
| 6,383,083 | B1 | | 5/2002 | Johnston | |

* cited by examiner

*Primary Examiner*—Kien T. Nguyen
(74) *Attorney, Agent, or Firm*—Renner, Otto, Boisselle & Sklar, LLP

(57) ABSTRACT

A playground apparatus having at least one support base for stabilizing the apparatus. A plurality of pockets are formed within the support base. The playground apparatus also includes at least one side member disposed within the pockets. A plurality of fasteners secure the side members disposed within the pocket to the support base to form the playground apparatus.

19 Claims, 6 Drawing Sheets

TEETER-TOTTER

TECHNICAL FIELD OF THE INVENTION

The present invention relates in general to a playground apparatus, and more particularly, to an easy to assemble teeter-totter.

BACKGROUND OF THE INVENTION

Teeter-totters are well known playground amusement apparatuses. Teeter-totters are typically constructed as either part of a commercial or backyard playground set or as a stand alone device. Stand alone teeter-totters generally include a base that supports the teeter-totter. In fact, some stand alone teeter-totters include a curved or arc shaped base that provides a pivot arrangement to enable the user to rock the teeter-totter back and forth.

Another example of a stand alone teeter-totter is U.S. Pat. No. 2,198,947 to Olson which illustrates a collapsible teeter-totter. The teeter-totter includes a stand, an intermediate or lever section and seat sections that are attached to each end of the intermediate section. The stand is formed from two frame units. The first unit includes a base member and upstanding legs with a laterally disposed head portion. The second unit includes legs that extend upwards from a base member. The intermediate or lever section is disposed between the laterally disposed head portions. The intermediate or lever section is connected to the laterally disposed head portions of the stand by a bearing unit and a fulcrum pin.

U.S. Pat. No. 5,776,002 to Weber illustrates a teeter-totter designed for one person with a seat on one end and counterweights at the other end. The teeter-totter includes a pivot arrangement positioned at the center of the apparatus. The pivot arrangement includes a pivot and a shaft socket joint which enables the teeter-totter to move up, down and to rotate 360 degrees around the base. However, the full range of motion of this device makes it difficult to control thereby increasing the chances of injury for children.

U.S. Pat. No. 6,379,256 to Gatto illustrates a pivoting apparatus for a single user having a base and an arm with a seat. The base includes a coupling device connected to the center of the base. The coupling device includes a channel which receives an end of the arm and a biasing device. The coupling device also includes openings for receiving a fastener to secure the arm to the coupling device.

U.S. Pat. No. 6,383,083 to Johnston illustrates a pivoting apparatus with a frame and a lever member with seats and handles. The frame includes a base member and an upright support member. The upright support member has a curved member and an opening. The center of the lever member is connected to the support member and the handle is connected to the lever member. The apparatus pivots when the user moves the handle in a forward or backward direction which causes the handle to engage the curved member. This pivoting apparatus, however, would be difficult for children to activate.

Thus, it would be desirable to provide an easy to assemble teeter-totter that provides lateral support for two children while restricting the teeter-totter to movement in an up and down direction.

SUMMARY OF THE INVENTION

According to one aspect of the invention, a molded plastic base for a playground apparatus, the apparatus including at least one pair of wooden legs, each pair of wooden legs extend and converge in an upwardly direction, the base comprising a pair of molded pockets for each pair of legs, each pocket includes side walls and an end wall at right angles to one another and defining a leg receiving opening, the opening have a size corresponding to one of standard size lumber, the opening having a longitudinal axis which extends upwardly and converges with the longitudinal axis of the respective pocket of the pair of pockets, whereby the pocket is sized to accept standard lumber, such as a 2×4 or 4×4, having square cut ends.

According to another aspect of the invention, a molded plastic shoulder for a playground apparatus, the playground apparatus including at least one pair of wooden legs, each pair of wooden legs extend and diverge in a downwardly direction from the shoulder, the molded plastic shoulder comprising an M-shaped cross-section opening facing downwardly, and a first lateral side wall opposite a second lateral side wall, the lateral side walls define a perimeter of the opening and are spaced apart a distance corresponding to one of a standard size lumber, whereby the M-shaped cross-section opening receives the diverging pair of legs and the legs are each a section of standard size lumber having a right angle cut end.

Another aspect of the invention is a kit of molded plastic components to be used together with wooden boards, to assemble a playground apparatus, requiring only the skill of a typical adult, the playground apparatus including a plurality of legs, the assembly requiring only 90 degree cuts of the wooden boards, the kit comprising at least on molded plastic base having at least one molded pocket for each leg, each pocket having side walls which define a perimeter having right angles and an end wall perpendicular to the side walls, each pocket defining a longitudinal axis which extends out of the pocket parallel to the side walls, at least one molded plastic shoulder having at least one molded pocket for each leg, each pocket having side walls which define a perimeter having fight angles and an end wall perpendicular to the side walls, each pocket defining a longitudinal axis which extends out of the pocket parallel to the side walls, wherein the at least one molded plastic shoulder may be positioned above the at least one molded plastic base and aligned so that each longitudinal axis of the shoulder is aligned in coincidence with a respective longitudinal axis of the base, whereby a user may assemble the playground apparatus with standard size wooden boards, having right angle cut ends, extending within respective pockets of the base and shoulder.

And yet another aspect of the invention is a playground apparatus, comprising two pairs of wooden legs, each leg having an upper end and a lower end, each pair extending and converging upwardly a molded plastic base having four pockets, each pocket arranged to receive a respective lower end, each pocket having side walls and an end wall, the side walls and end wall at right angles to one another a molded plastic shoulder having a shaft, a protrusion and four pockets, each pocket arranged to receive a respective upper end, each pocket having side walls and end walls, the side walls and end walls at right angles to one another a wooden teeter-totter board 100 extending over the shaft a bracket having channel walls and coupling the board to the shaft, wherein the protrusion of the shoulder extends between the channel walls and maintains alignment of the teeter-totter board.

BRIEF DESCRIPTION OF THE DRAWINGS

Further aspects of the invention and their advantages may be discerned from the following description when taken in conjunction with the drawings, in which like characters number like parts and in which.

DETAILED DESCRIPTION OF ILLUSTRATED EMBODIMENT

Figure 1:
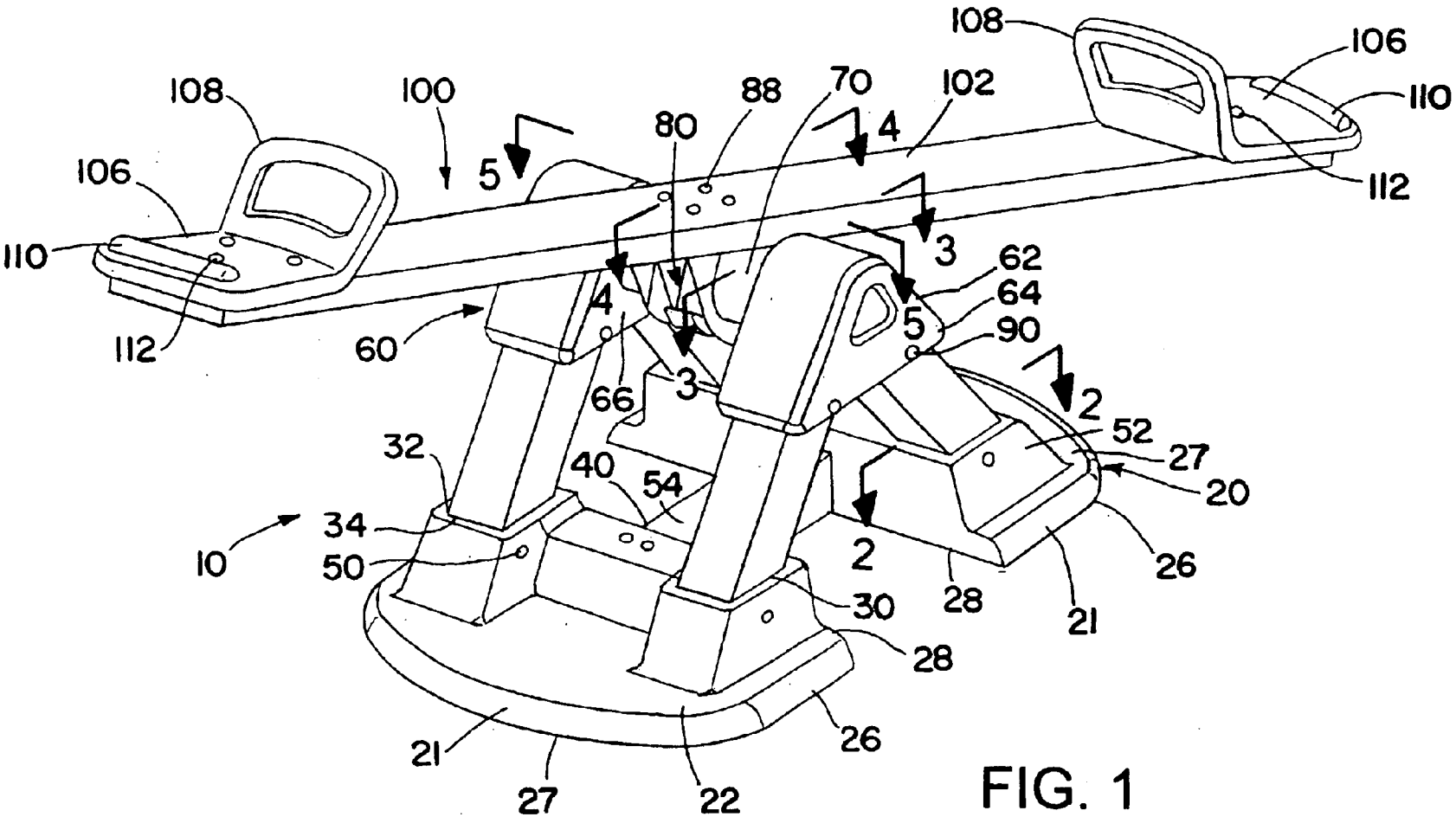
FIG. 1 is a perspective view of the teeter-totter of the present invention.

FIG. 1 illustrates the teeter-totter of the present invention indicated in general at 10. The teeter-totter includes a base 20, a shoulder 60 and a lever or teeter-totter board 100. The base 20 is designed to equally distribute the load exerted on the teeter-totter. The shoulder 60 encapsulates lateral supports 52 that extend outward from the base 20 and the lever 100 is pivotally connected to the shoulder 60.

The base 20 includes two base portions 21 preferably rotationally molded from a plastic, such as polyethylene. Alternatively, each base portion 21 may also be blow molded from a plastic or injection molded from a plastic. In the illustrated embodiment, each base portion 21 has two straight sides 26 that are joined by a circular or arc shaped outer end 27 and a straight inner end 28 to form the semi-circular shaped base portion 21. The base portion 21 may also be formed from other shapes, such as a rectangle or triangle.

Each base portion 21 includes a plurality of pockets 30 and 40 that are formed during the rotational molding process of the base portions 21. The base portions 21 include two top raised pockets 30 that extend from the top surface 22 of the base portions 21 and one side pocket 40 formed within the inner end 28 of the base portions 21. The pockets 30 formed within the top surface 22 of the base portions 21 are positioned near each side 26 of the base portions 21.

Figure 2:
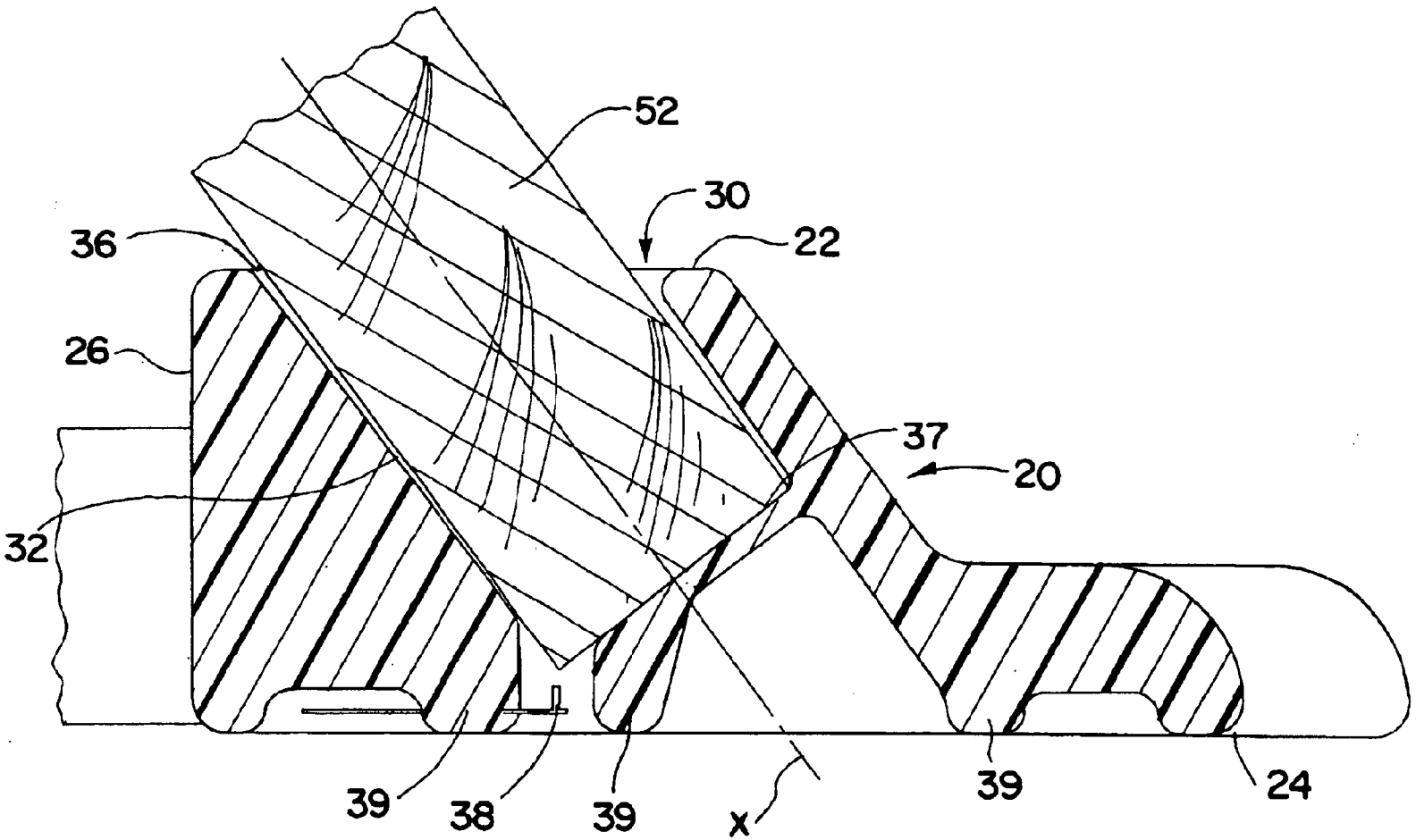
FIG. 2 is a cross sectional view of the base taken along line 2—2 of the teeter-totter of FIG. 1.

The top raised pockets 30 extend along a longitudinal axis X at an angle towards the inner end 28 of the base portions 21 (see FIG. 2). The pockets 30 include four side walls 32, 34, a rectangular or square opening 36 and a bottom surface or end wall 37. The rectangular opening 36 is sized to receive a standard size wood board or beam, such as a 2×2, 2×4, or 4×4, for example. Further, the pockets are designed to receive the wood beam with square cut ends, i.e. not cut at an angle.

Lateral supports 52 are disposed in each of the top raised pockets 30. The lateral supports 52 are pieces of wood that are identical in size. In the illustrated embodiment, 4×4 sections of wood boards are used to form the lateral supports 52. However, as with the rectangular opening, the dimensions of the wood sections may vary depending on the size of the pocket, the load requirements and the desired height of the teeter-totter.

The side pocket 40 is positioned at the center of the inner end 28 of the base portions 21. The side pocket 40 also includes a rectangular base support opening 42 that is sized to receive a standard size wood board, such as a 4×4. The side pocket may also be designed to receive various dimensioned wood pieces.

A cross support 54 is positioned within each of the side pockets. The cross support 54 is a piece of wood which is, preferably, the same size as the lateral supports 52. However, the size of the wood piece that forms the cross support 54 may also vary depending on the size of the pocket, load requirements or the height of the teeter-totter. The cross support 54 joins two base portions 21 to form the symmetrical base 20 of the teeter-totter illustrated in FIG. 1. The cross support 54 provides additional support for the teeter-totter and helps to distribute the load exerted on the teeter-totter.

Fasteners 50 secure the wood lateral supports 52 and the wood cross support 54 to their respective pockets. More specifically, fasteners 50, such as a screw, for example, are inserted through the top surface of the base 22 above the side pocket 40 and into the wood cross support 54 to secure the cross support 54. Fasteners 50 are inserted at the side of each raised pocket 30 and into the wood lateral supports 52 to secure the wood lateral supports 52 in the raised pockets 30.

FIG. 2 illustrates a cross section of one of the raised pockets 30 of the teeter-totter. As discussed above, each raised pocket 30 is formed at an angle with respect to the base 20. In the illustrated embodiment, the raised pockets 30 are formed at approximately a 45 degree angle with respect to the base 20. Since the end wall 37 of the pocket 30 is angled, a piece of wood having its ends cut at a 90 degree angle may be used to form the lateral supports 52, as shown in FIG. 2. This enables the consumer to use readily accessible wood pieces instead of requesting or preparing a wood piece having its ends cut at a specific angle in order for the wood piece to be disposed at an angle. Lumber stores often will only provide square cuts and not angled cuts. Thus, the typical adult may not have ready access to angle cut wood unless they own power tools capable of providing such angled cuts.

As discussed above, the raised pockets 30 and the side pocket 40 are formed as part of the base 20 when the base 20 is rotationally molded. Since rotational molded products are generally hollow, each raised pocket 30 includes a core through or relief opening 38. The core through 38 and related support structure 39 ties together the end wall 37 and side walls 32, 34 of the pocket to the bottom 24 of the base 20. This provides additional strength to the base portions since the core through 38 prevents one wall from moving independently of the other wall. Here, the core through 38 is designed to prevent the edge of the lateral supports from ripping the bottom 37 of the pockets 30 when a force is exerted on the teeter-totter, and to transfer the load from the lateral supports 52 to the surface (not shown) upon what the apparatus rests.

Figure 3:
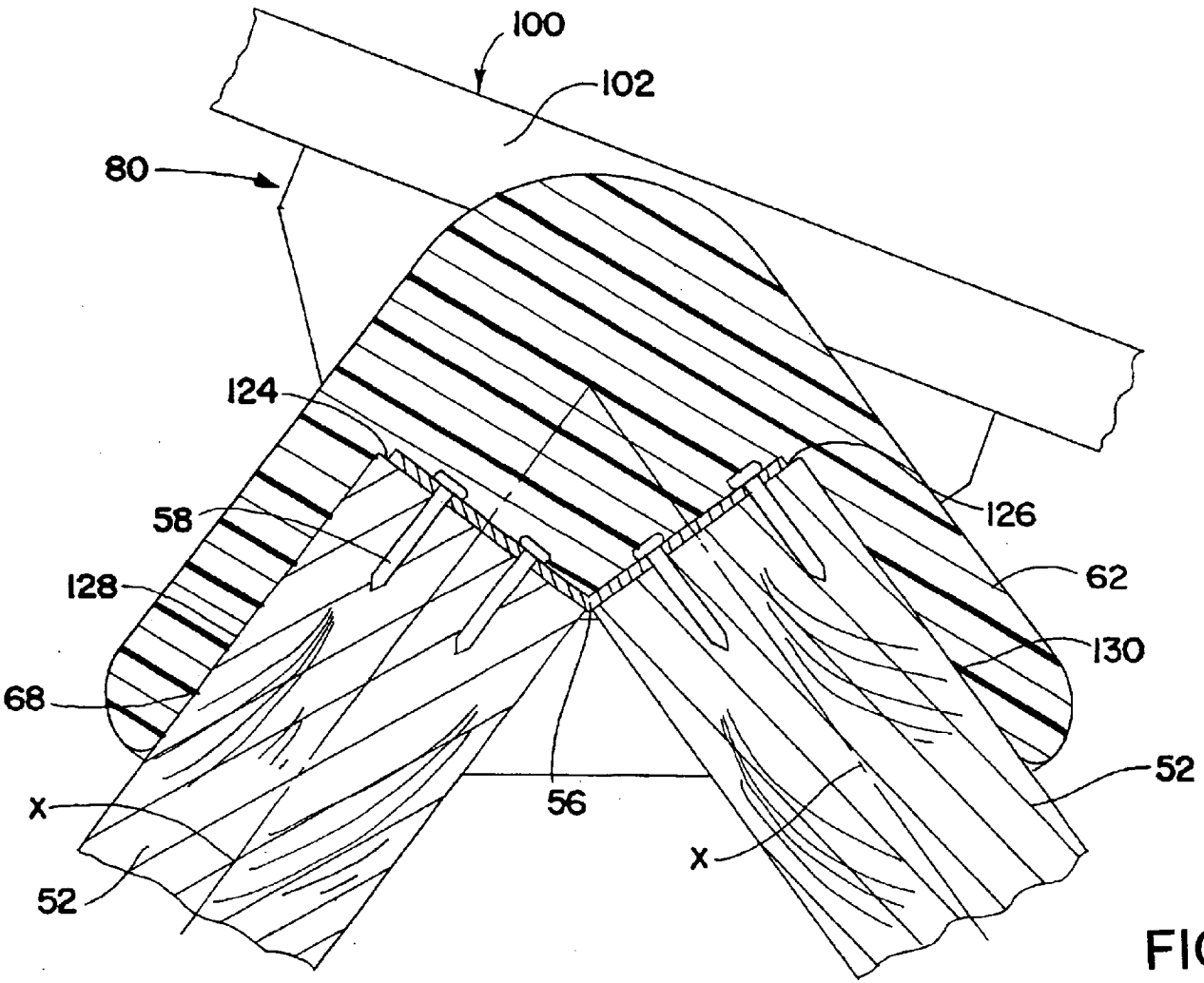
FIG. 3 is a cross sectional view of the shoulder oriented over the legs taken along line 3—3 of the teeter-totter of FIG. 1.

FIG. 3 illustrates a cross section of one side of the lateral supports 52 and the shoulder 60 of the teeter-totter. Since the raised pockets 30 are formed at an angle with respect to the base 20, the lateral supports 52 of each base portion 21 are situated at an angle towards the inner end 28 of the base portion 21 (see FIG. 1). The lateral supports are also disposed at an angle towards one of the lateral supports 52 of the adjacent base portion 21. The angled lateral supports 52 are connected to each other by a bracket 56. The bracket 56 is approximately "V" shaped. However, the shape of the bracket may vary so as to correspond with the angle defined by the lateral supports and, as discussed below, the end walls of the M-shaped opening of the shoulder (see FIG. 3). The bracket 56 is nailed to each end of the angled lateral supports 52. The lateral supports 52 on the opposite side of the base portions 21 are connected in a similar fashion.

After the lateral supports 52 from each side of the base portions 21 are connected, the opposing ends 62 of the shoulder 60 are positioned over the lateral supports 52. As shown in FIG. 1, the shoulder 60 includes two opposing ends 62 join by a cylindrical cross bar or shaft 70. The shoulder 60 is preferably rotationally molded from a plastic, such as polyethylene. However, the shoulder may also be blow molded from a plastic or injection molded from a plastic. The ends 62 of the shoulder 60 are triangular in shape with a round apex. The underside of each end 62 of the shoulder 60 has a "M" shaped cross-section opening 68.

Figure 5:
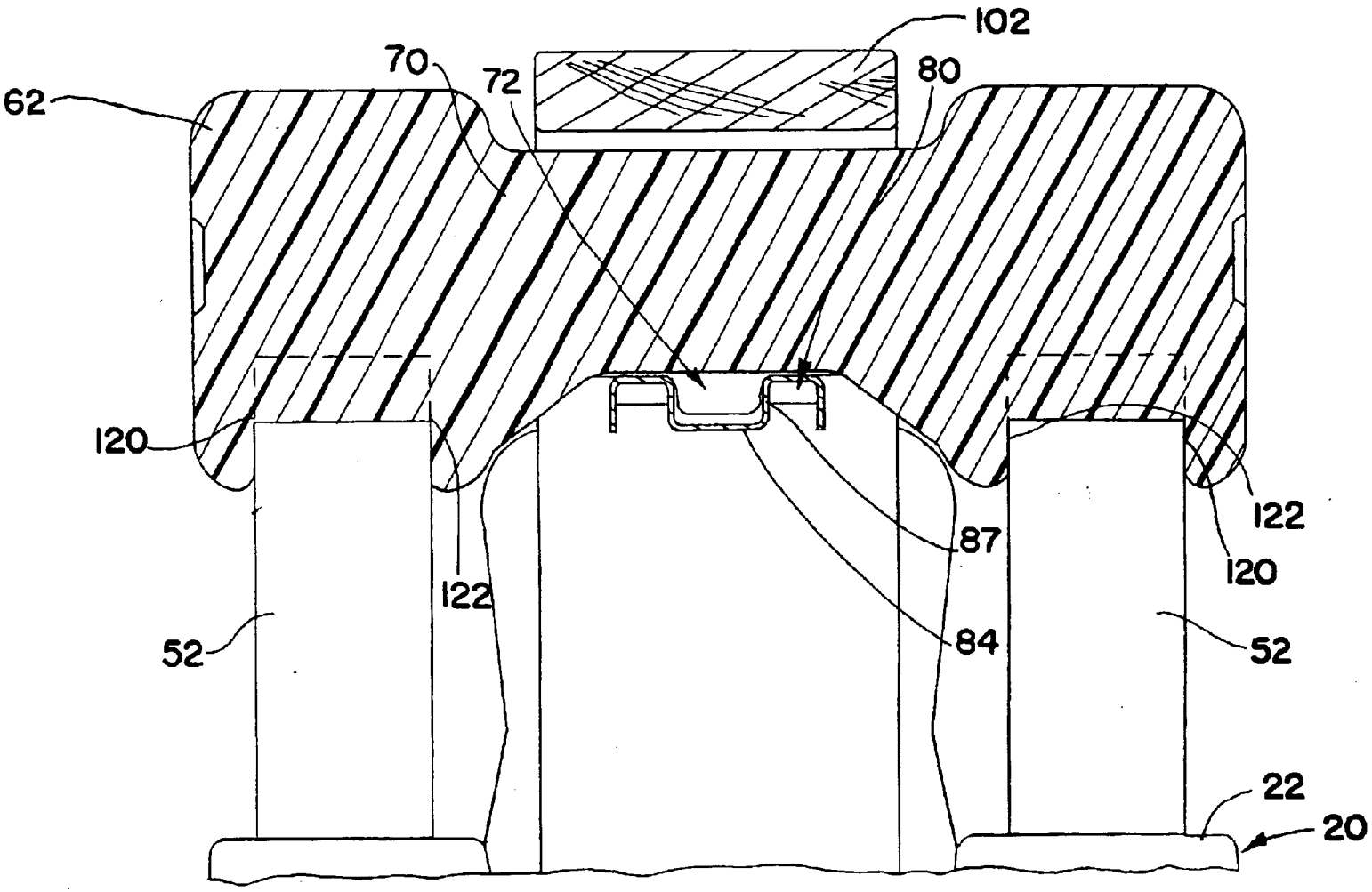
FIG. 5 is a cross sectional view taken along line 5—5 of the teeter-totter of FIG. 1.

The perimeter of the M-shaped opening 68 is defined by a first lateral side wall 120 positioned opposite a second lateral side wall 122 (see FIG. 5). The lateral side walls are spaced apart a distance that corresponds to one of a standard size piece of lumber. The M-shaped opening is also defined by a first end wall 124 that adjoins a second end wall 126. The first and second end walls may be adjoined at a right angle thereby forming a 270° angle within the opening. A first side wall 128 extends from the first end wall and a second side wall 130 extends from the second end wall. Thus, the first and second end walls and the first and second side walls define the M-shaped cross-section opening in the underside of the shoulder. The "M" shaped opening 68 houses the lateral supports 52, as shown in FIG. 3. The lateral side walls, end walls and side walls enable the shoulder to securely hold the lateral supports in place. The ends 62 of the shoulder 60 cover the ends of the lateral support 52 as well as the upper portion of the lateral supports 52 and the bracket 56. The shoulder 60 maintains the lateral supports 52 a predetermined distance from each other to support the teeter-totter.

As shown in FIG. 1, the lateral supports 52 are secured to the ends 62 of the shoulder 60 via fasteners 90 near the bottom of each end 62 of the shoulder 60. Preferably, a fastener 90 is installed at both the outer surface 64 and inner surface 66 of each end 62 of the shoulder 60.

Figure 4:
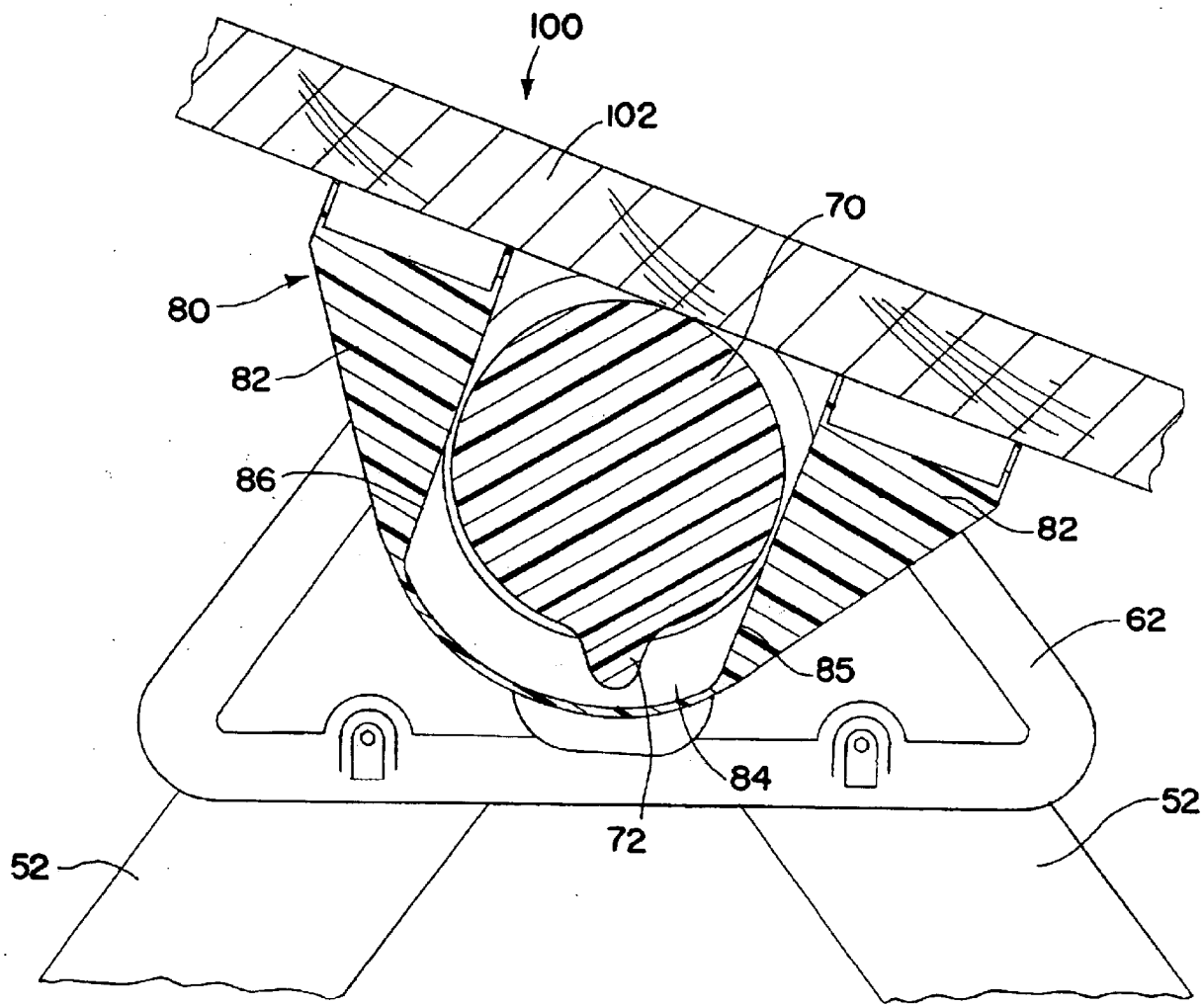
FIG. 4 is a cross sectional view of the shoulder taken long line 4—4 of the teeter-totter of FIG. 1.

A cross section of the cylindrical shaft or cross bar 70 of the shoulder 60 is illustrated in FIG. 4. The cross bar 70 includes a pivot protrusion 72 that is positioned at the center of the cross bar 70. The pivot protrusion 72 extends downwardly from the bottom surface of the cross bar 70.

FIG. 4 also illustrates the pivot bracket 80. The pivot bracket 80 includes two arms 82 that are connected by an arc shaped channel 84. The channel 84 also includes channel walls 87 (see FIG. 5) which restrict the area of travel within the channel 84. The pivot bracket 80 is positioned on the cross bar 70 such that the downwardly extending protrusion 72 is disposed within the channel 84. As a result, the teeter-totter remains centered on the cross bar 70.

FIG. 1 illustrates the pivot bracket secured to the lever 100. The pivot bracket 80 is secured via fasteners 88, such as screws or bolts, to the center of the wood beam 102 that forms the lever 100. A seat 106 is secured via fasteners 112, such as screws or bolts, to each end of the wood beam 102. The seat 106 includes an arc shaped handle 108 and a slightly raised back 110. The raised back 110 on the seat 106 prevents a child from sliding backward off of the seat 106. The handle 108 provides a device for the child to hold on to while using the teeter-totter.

Figure 6:
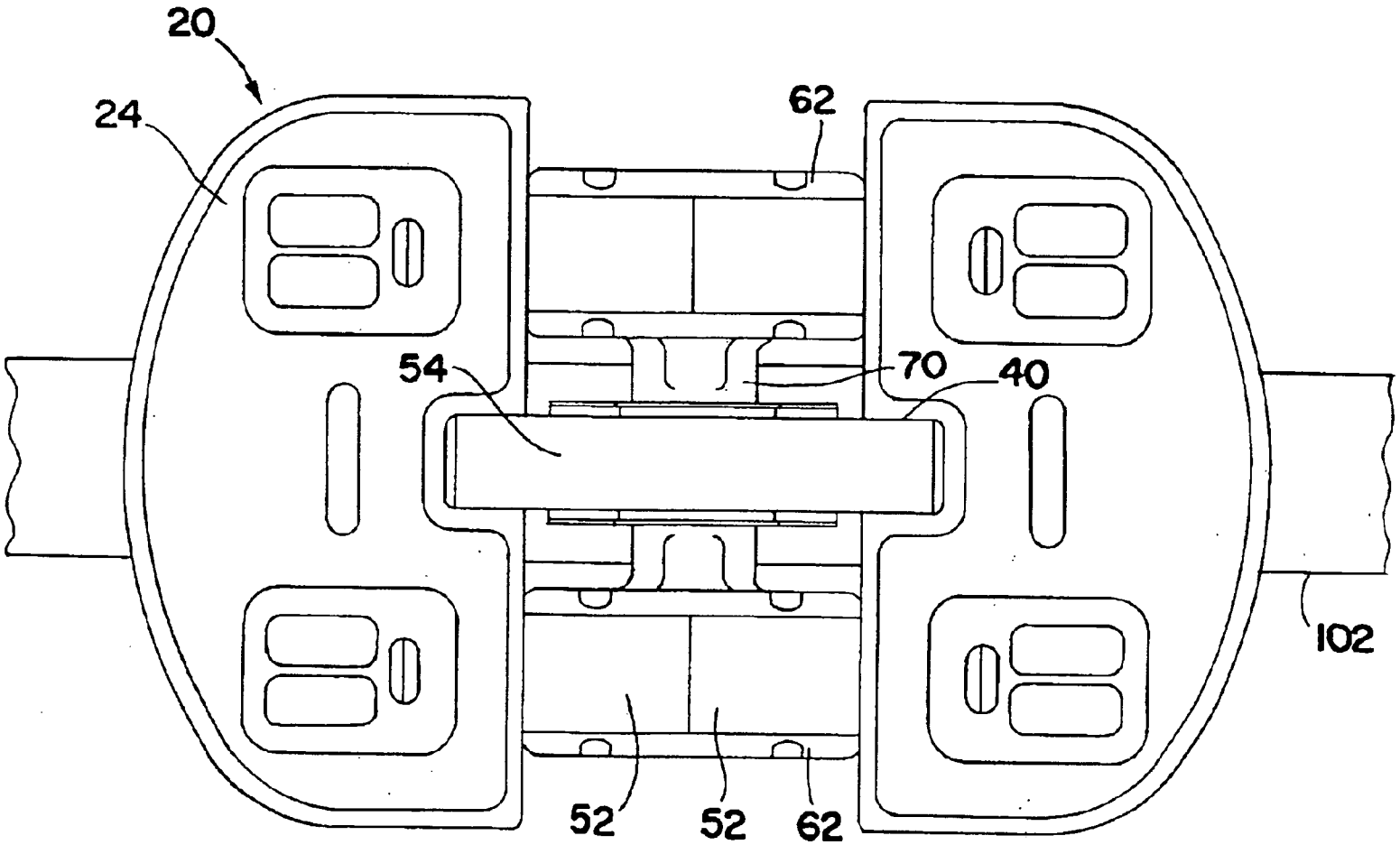
FIG. 6 is bottom plan view of the teeter-totter of FIG. 1.

FIG. 6 illustrates the bottom 24 of the base portion 21 and the underside of the lateral supports 52, the shoulder 60 and the lever 100 of the assembled teeter-totter of the present invention. The bottom 24 of base portion 21 of the teeter-totter is designed to be placed on various surfaces, such as wood chips or grass. Often these surfaces are not level. However, since the base covers a large surface area, the base is capable of stabilizing the teeter-totter on the uneven surface. As a result, the base portion 21 will not slide even if it is placed on,an uneven surface.

The lateral supports 52 provide lateral stability for the teeter-totter. The weight exerted on the lateral supports is disburse through out the portions 21 and the cross support 54. As a result, the base is of the teeter-totter is design to support approximately 450 pounds.

The teeter-totter of the present invention is easy to assemble. The teeter-totter is sold as a "kit of parts." The kit includes the rotational molded plastic base portions, shoulder and seats. The kit also includes the pivot bracket and the V-shaped brackets. The fasteners used to secure the members of the teeter-totter to each other may also be part of the kit. Instead of being part of the kit, the fasteners may also be purchased separately.

A list of additional required materials is also provided with the kit. Typically, the additional required materials include wood beams to form the lever, the lateral supports and the cross support. Since each of the pockets has a rectangular cross section, the wood pieces for the lateral supports and the cross support do not have to be specially cut except to length. To assemble the teeter-totter from the kit, the consumer inserts the wood pieces into the pockets. Next, the consumers use the fasteners to secure the wood pieces to the plastic base members. The consumer also secures the V-shaped brackets to the ends of the adjacent lateral supports.

After the lateral supports are secured, the shoulder may be positioned over and fastened to the lateral supports. A pivot bracket is installed over the protrusion that extends from the bottom of the pivot bracket. The consumer centers a wood beam over the shoulder and secures the pivot bracket to the underside of the wood beam. The consumer secures a seat to each end of the beam to complete the teeter-totter.

The ends of the lateral supports, the cross support and the lever are covered by either the pockets, the shoulder or the seats. As a result, there are no rough edges that are exposed to children who use the teeter-totter. This protects the children for injuring themselves on the ends of the wood pieces.

Although a kit for a teeter-totter has been described and illustrated, additional playground structures may be formed in a similar fashion. For example, playground structures, such as playhouses, sandboxes and picnic tables, may be formed from rotational molded plastics with at least one pocket formed therein. The pockets would also have a rectangular cross section wherein each pocket would be designed to receive a piece of wood cut at 90 degrees. However, if desired, the pockets could be designed with a cross section that receives the wood cut at a different angle, such as 45 degrees.

The various playground structures may also be sold as a kit where the plastic members and the fasteners are part of a kit. The kit would include a list of the additional materials the consumer needs to purchase, such as the wood pieces. The additional playground structures would also be easy to assemble since the consumer merely inserts the wood pieces into the desired pocket and fastens the wood pieces to the plastic members of the various structures.

While the preferred embodiment of this invention has been shown and described, it will be apparent to those skilled in the art that changes and modifications may be made therein without departing from the spirit of the invention, the scope of which is defined by the appended claims.

We claim:

1. A molded plastic base for a playground apparatus, the apparatus including at least one pair of wooden legs, each pair of wooden legs extend and converge in an upwardly direction, the base comprising:

a pair of molded pockets for each pair of legs, each pocket includes side walls and an end wall at right angles to one another and defining a leg receiving opening, the opening having a size corresponding to one of standard size lumber, the opening having a longitudinal axis which extends upwardly and converges with the longitudinal axis of the respective pocket of the pair of pockets, whereby the pocket is sized to accept standard lumber, having square cut ends.

2. The base of claim 1, further comprising a relief opening extending horizontally at the lowest point where the end wall converges with one of the side walls, whereby the relief opening reduces the likelihood of the wooden leg rupturing the pocket.

3. The base of claim 1 or 2, further comprising a load bearing plastic support structure extending from each side wall and end wall to the bottom of the base, whereby the weight supported by the legs is transferred to the surface upon which the apparatus rests.

4. The base of claim 1, wherein the base includes a first portion facing a second portion, where each portion includes one of the pair of molded pockets.

5. The base of claim 4, wherein each base portion includes two molded pockets, and a base support opening which faces the base support opening of the respective base portion, each base support opening having a size corresponding to one of standard size lumber, whereby a section of standard size lumber having a right angled cut may extend between the base portions and within the respective base support opening so as to increase and improve the stability of the playground apparatus.

6. A molded plastic shoulder for a playground apparatus, the playground apparatus including at least one pair of wooden legs, each pair of wooden legs extend and diverge in a downwardly direction from the shoulder, the molded plastic shoulder comprising:

an M-shaped cross-section opening facing downwardly, and a first lateral side wall opposite a second lateral side wall, the lateral side walls define lateral boundaries of the opening and are spaced apart a distance corresponding to one of a standard size lumber, whereby the M-shaped cross-section opening is sized to receive a diverging pair of legs, each leg corresponding to standard size lumber having a right angle cut end, the M-shaped cross-section opening is defined by a first end wall adjoining a second end wall at a right angle and forming a 270° angle, a first side wall extending from the first end wall and a second side wall extending from the second end wall, the first and second end walls and the first and second side walls define the M-shaped cross-section opening and the lateral side walls together with the first and second side walls form a perimeter of the M-shaped cross-section opening, whereby the wooden legs are held securely in place by the shoulder.

7. A molded plastic shoulder for a playground apparatus, the playground apparatus including at least one pair of wooden legs, each pair of wooden legs extend and diverge in a downwardly direction from the shoulder, the molded plastic shoulder comprising:

an M-shaped cross-section opening facing downwardly, and a first lateral side wall opposite a second lateral side wall, the lateral side walls define lateral boundaries of the opening and are spaced apart a distance corresponding to one of a standard size lumber, whereby the M-shaped cross-section opening is sized to receive a diverging pair of legs, each leg corresponding to standard size lumber having a right angle cut end, wherein the shoulder includes opposing ends, and an M-shaped cross-section opening is located at each end, and a cylindrical shaft extends between the opposing ends, the cylindrical shaft includes an alignment protrusion, whereby the alignment protrusion may be used to maintain alignment of additional structure to be mounted on the cylindrical shaft for pivoted movement about the cylindrical shaft.

8. A kit of molded plastic components to be used together with wooden boards, to assemble a playground apparatus, requiring only the skill of a typical adult, the playground apparatus including a plurality of legs, the assembly requiring only 90 degree cuts of the wooded boards, the kit comprising:

at least one molded plastic base having at least one molded pocket for each leg, each pocket having side walls which define a perimeter having right angles and an end wall perpendicular to the side walls, each pocket defining a longitudinal axis which extends out of the pocket parallel to the side walls;

at least one molded plastic shoulder having at least one molded pocket for each leg, each pocket having side walls which define a perimeter having right angles and an end wall perpendicular to the side walls, each pocket defining a longitudinal axis which extends out of the pocket parallel to the side walls, wherein the at least one molded plastic shoulder may be positioned above the at least one molded plastic base and aligned so that each longitudinal axis of the shoulder is aligned in coincidence with a respective longitudinal axis of the base, whereby a user may assemble the playground apparatus with standard size wooden boards, having right angle cut ends, extending within respective pockets of the base and shoulder.

9. The kit of claim 8, further including fasteners, whereby a fastener may be inserted through a side wall of a pocket and into the leg extending within the pocket.

10. The kit of claim 8, wherein the at least one molded plastic base includes a first base portion and a second base portion, each of the base portions include a base support pocket having side walls which define a perimeter having right angles and an end wall perpendicular to the side walls, each base support pocket defines a longitudinal axis extending out of the base support pocket in a horizontal direction parallel to the horizontal plane of the base portions, whereby with the shoulder aligned with the base portions, the base support pockets face one another, and a wooden support of standard size lumber may extend between and within the base support pockets, to provide support and stability between the base portions and to the assembled playground apparatus.

11. The kit of claim 8, wherein at least two pockets of the base are oriented in an angular position with the respective longitudinal axis extending upward and converging, and at least two pockets of the shoulder are oriented in an angular position with the respective longitudinal axis extending downwardly and diverging from one another, whereby the assembled playground apparatus includes wooden legs having upper ends adjacent one another and which extend downward in a diverging manner.

12. The kit of claim 11, where the at least two angularly oriented pockets of the shoulder form an M-shaped cross-section opening facing downwardly.

13. The kit of claim 12, wherein the base includes a first base portion and a second base portion, each base portion includes two angularly oriented pockets, each defining an opened lower edge and each having load bearing support structure extending to the bottom of the base.

14. The kit of claim 13, wherein the shoulder includes a cylindrical shaft extending between a first and a second M-shaped cross-section opening, the shaft having a protrusion extending therefrom, and further comprising a bracket having arcuate shaped channel walls, the channel walls defining ends, and an abutment surface located at each end of the channel walls, and further comprising two V-shaped brackets, whereby the kit may be assembled to form a teeter-totter having two wooden legs extending downwardly and outwardly from each side of the shoulder, and into respective pockets of the first and second base portion, with each V-shaped bracket secured at the top of pairs of wooden legs, and with a wooden beam extending between the first and second base portion and within the base support pockets, the bracket secured below and about the cylindrical shaft and to a wooden teeter-totter beam, with the protrusion extending between the channel walls limiting the movement of the teeter-totter beam.

15. A playground apparatus, comprising:

two pairs of wooden legs, each leg having an upper end and lower end, each pair extending and converging upwardly;

a molded plastic base having four pockets, each pocket arranged to receive a respective lower end, each pocket having side walls and an end wall, the side walls at right angles to one another;

a molded plastic shoulder having a shaft, a protrusion and four pockets, each pocket arranged to receive a respective upper end, each pocket having side walls and end walls, the side walls at right angles to one another;

a wooden teeter-totter board extending over the shaft;

a bracket having channel walls and coupling the board to the shaft, wherein the protrusion of the shoulder extends between the channel walls and maintains alignment of the teeter-totter board.

16. The playground apparatus of claim 15, wherein pairs of the shoulder pockets form an M-shaped cross-section opening facing downwardly, and the end walls are at right angles to the side walls.

17. The playground apparatus of claim 15, wherein the base pockets define an open lower edge and each side wall and end wall include support structures which extend to the bottom of the base.

18. The playground apparatus of claim 15, wherein the base includes a first base portion and a second base portion facing the first base portion in spaced apart relationship, each base portion having a base support pocket which opens and faces the other base support pocket, and a wooden beam extends between the base portions and within the base support pockets.

19. The playground apparatus of claim 15, further comprising a V-shaped bracket secured to the upper ends of converging pairs of legs.

* * * * *